US010605428B2

(12) United States Patent
Ecker-Endl

(10) Patent No.: US 10,605,428 B2
(45) Date of Patent: Mar. 31, 2020

(54) LIGHTING UNIT FOR A MOTOR VEHICLE HEADLIGHT FOR GENERATING AT LEAST TWO LIGHT DISTRIBUTIONS

(71) Applicant: ZKW GROUP GMBH, Wieselburg (AT)

(72) Inventor: Markus Ecker-Endl, Krems an der Donau (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 16/326,271

(22) PCT Filed: Jul. 31, 2017

(86) PCT No.: PCT/AT2017/060193

§ 371 (c)(1),
(2) Date: Feb. 18, 2019

(87) PCT Pub. No.: WO2018/032025

PCT Pub. Date: Feb. 22, 2018

(65) Prior Publication Data

US 2019/0186708 A1 Jun. 20, 2019

(30) Foreign Application Priority Data

Aug. 19, 2016 (AT) ..... A 50749/2016

(51) Int. Cl.
*F21V 5/00* (2018.01)
*F21S 41/663* (2018.01)
(Continued)

(52) U.S. Cl.
CPC ..... *F21S 41/663* (2018.01); *F21S 41/147* (2018.01); *F21S 41/148* (2018.01); *F21S 41/27* (2018.01);
(Continued)

(58) Field of Classification Search
CPC ..... F21S 41/663; F21S 41/336; F21S 41/147; F21S 41/148; F21S 41/321; F21S 41/337;
(Continued)

(56) References Cited

U.S. PATENT DOCUMENTS

2006/0285347 A1 12/2006 Okada
2007/0211487 A1 9/2007 Sormani
(Continued)

FOREIGN PATENT DOCUMENTS

DE 10234110 A1 2/2004
DE 102014205994 A1 10/2015
(Continued)

*Primary Examiner* — Ali Alavi
(74) *Attorney, Agent, or Firm* — Eversheds Sutherland (US) LLP

(57) ABSTRACT

The invention relates to a lighting unit for a motor vehicle headlight for generating at least two light distributions, wherein the lighting unit comprises: a first light source (1) for generating a first light distribution, a second light source (2) for generating a second light distribution, a reflector (3), an exit lens (4) and collimators (5, 6; 5, 6*a*, 6*b*, 6*c*) into which the light sources (1, 2) can feed light, wherein the reflector (3) deflects, in the direction of the exit lens (4), the light rays of the light beams (S1, S2) exiting the collimators (5, 6; 5, 6*a*, 6*b*, 6*c*), the reflector (3), exit lens (4) and collimators (5, 6; 5, 6*a*, 6*b*, 6*c*) are formed from a translucent body (100) in which light rays (S1, S2) propagate by means of total reflection, the reflector (3) has a first reflector surface region (30) which receives light exclusively from the at least one first light source (1), and the reflector (3) has a second reflector surface region (31) which receives light exclusively from the at least one second light source (2), and wherein the exit lens (4) has a first exit lens region (40) which receives light exclusively from the first reflector surface region (30), and the exit lens (4) has a second exit lens region (41) which receives light exclusively from the second reflector surface
(Continued)

Figure 1:
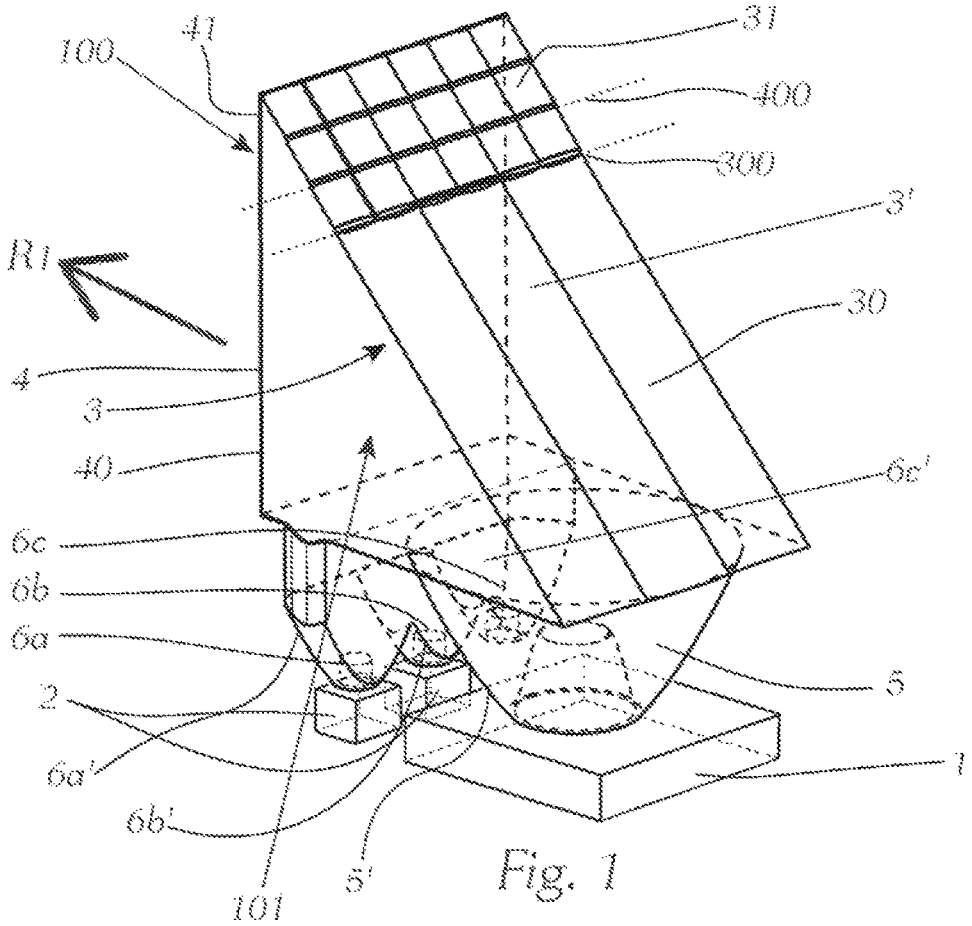

region (31), and wherein light irradiated via the first exit lens region (40) is imaged as a first light distribution and light irradiated via the second exit lens region (4) is imaged as a second light distribution.

21 Claims, 6 Drawing Sheets

(51) Int. Cl.
*F21S 41/20* (2018.01)
*F21S 41/27* (2018.01)
*F21S 41/147* (2018.01)
*F21S 41/32* (2018.01)
*F21S 41/33* (2018.01)
*F21S 41/148* (2018.01)

(52) U.S. Cl.
CPC ..... *F21S 41/285* (2018.01); *F21S 41/321* (2018.01); *F21S 41/322* (2018.01); *F21S 41/336* (2018.01); *F21S 41/337* (2018.01)

(58) Field of Classification Search
CPC ..... F21S 41/285; F21S 41/27; F21S 41/322; F21S 41/24; F21S 41/25; F21S 45/47; F21Y 2115/10
USPC ..... 362/521
See application file for complete search history.

(56) References Cited

U.S. PATENT DOCUMENTS

2014/0016335 A1* 1/2014 Cho ..... B60Q 1/06 362/466
2014/0036526 A1* 2/2014 Sato ..... F21S 41/24 362/518
2014/0321145 A1* 10/2014 Anzai ..... F21S 41/24 362/516
2016/0061401 A1* 3/2016 Seyrlehner ..... B60Q 1/0041 362/509
2016/0245471 A1* 8/2016 Nakazato ..... F21S 41/14
2017/0211771 A1* 7/2017 Nishimura ..... F21S 41/322

FOREIGN PATENT DOCUMENTS

WO 2013014046 A1 1/2013
WO 2017174659 A1 10/2017

* cited by examiner

LIGHTING UNIT FOR A MOTOR VEHICLE HEADLIGHT FOR GENERATING AT LEAST TWO LIGHT DISTRIBUTIONS

The invention relates to a lighting unit for a motor-vehicle headlight for generating at least two, in particular different, light distributions, wherein the lighting unit comprises:

- at least one first light source for generating a first light distribution,
- at least one second light source for generating a second light distribution,
- a reflector,
- an exit lens, in particular in the form of a projection lens, and
- collimators into which the light sources can feed light, wherein
  - light of the at least one first light source is oriented by the at least one collimator associated with the at least one first light source to form a first light beam, and wherein
  - light of the at least one second light source is oriented by the at least one collimator associated with the at least one second light source to form a second light beam, and wherein the reflector deflects, in the direction of the exit lens, the light rays of the light beams exiting the collimators, and wherein the exit lens images the light rays reflected by the reflector in the form of the first and the second light distribution, and wherein the reflector, exit lens and collimators are formed from a translucent body, preferably a one-piece body, and wherein the light rays propagating in the translucent body are totally reflected at a reflector delimiting surface of the reflector and preferably at the collimator delimiting surfaces of the collimators.

The invention also relates to a lighting device for a motor vehicle headlight, which lighting device comprises one or more lighting units according to the invention.

Lastly, the invention also relates to a motor-vehicle headlight which comprises at least one lighting unit according to the invention and/or at least one lighting device according to the invention.

A lighting unit or a lighting device in the context of the present invention may be used in a motor-vehicle headlight in order to provide one light distribution or in particular two or more light distributions. Examples of light distributions of this kind in the context of the present invention which can be generated by a lighting unit or lighting device according to the invention are as follows: main beam distribution, partial main beam distribution, turn signal, daytime running light.

In particular, a lighting unit according to the invention or a lighting device according to the invention may be designed to generate a combination of main beam or partial main beam and turn signal A lighting unit according to the invention or a lighting device according to the invention may be designed to generate a combination of daytime running light and turn signal.

A lighting unit according to the invention or a lighting device according to the invention may be designed to generate a combination of main beam and daytime running light. If, in a lighting unit of this kind, the daytime running light is operated in a dimmed manner, a delimitation light may thus be generated and therefore the combination of delimitation light and main beam may thus additionally also be provided.

Current design trends often strive for motor vehicle headlights or lighting units or lighting devices for motor vehicle headlights of this kind that have a compact design and at the same time a good or high efficiency. A lighting unit as mentioned at the outset can additionally be designed to generate two lighting functions and/or signalling functions using a single translucent body.

The object of the invention is to describe a lighting unit for a motor vehicle headlight which satisfies the above-described requirements and improves the known lighting units further still.

This object is achieved with a lighting unit of the kind mentioned at the outset in that, in accordance with the invention, the reflector has a first reflector surface region which receives light exclusively from the at least one first light source, and the reflector has a second reflector surface region which receives light exclusively from the at least one second light source, and wherein the exit lens has a first exit lens region which receives light exclusively from the first reflector surface region, and the exit lens has a second exit lens region which receives light exclusively from the second reflector surface region, and wherein light irradiated via the first exit lens region is imaged as a first light distribution and light irradiated via the second exit lens region is imaged as a second light distribution.

With the arrangement according to the invention it is possible to adjust each light distribution independently of the others in an optimal manner to the desired and/or necessary requirements, wherein at the same time the arrangement itself remains compact.

A segmented light distribution can also be generated, that is to say each light distribution generated with the lighting unit forms a light segment of an overall light distribution. The generated light distribution, however, may also be part of an overall light distribution, for example in that each light distribution generates the form of the overall light distribution, and the totality of all light distributions then delivers the necessary luminous intensity in the light pattern.

In particular, these above-described light distributions can also be generated if two or more lighting units form a lighting device which can form these above-described light distributions.

It can be provided that the light sources each comprise one or more LEDs, wherein the light sources (what are known as "LED light sources") are preferably in each case single-chip LEDs.

It is preferably provided that the exit lens is formed as a flat or planar surface. The planar surface may also be curved for example, but preferably without unevennesses. It is advantageously provided here that the planar surface has at least G1 continuity.

In the case of a flat surface the design is simpler since merely one surface—the reflector surface regions—has to be designed.

For example, it is provided that the exit lens runs at an angle of 90° to a light exit plane of at least one collimator.

It can also be provided that the reflector is formed as a flat surface.

It can be provided here that the reflector runs at an angle of 45° to a light exit plane of at least one collimator.

The light exit planes of all collimators can run parallel to one another, and in this case the reflector is arranged accordingly at 45° to all light exit planes of collimators, and the exit lens is arranged at 90° to all light exit planes of the collimators.

It can be provided that the exit lens runs at an angle of 45° to the reflector.

It can be expedient if the first reflector surface region has a structuring, for example in that the first reflector surface region is divided into facets, by means of which structuring the light rays reflected by the reflector surface region are deflected in a vertical and/or horizontal direction in order to generate the first light distribution.

In this way, the light distribution generated by means of the first reflector surface region [corresponds to the light beam S1 in the drawings] can be optimally adapted.

The terms "vertical" and "horizontal" relate here to the light pattern in a screen projection, wherein accordingly "horizontal" means "in the direction of the H-axis" and "vertical" means "in the direction of the V-axis".

Alternatively or preferably additionally, it can be provided that a second reflector surface region has a structuring, for example in that a second reflector surface region is divided into facets, by means of which structuring the light rays reflected by the reflector surface region are deflected in a vertical and/or horizontal direction in order to generate the second light distribution.

In this way, the light distribution generated by means of second reflector surface region [corresponds to the light beam S2 in the drawings] can be optimally adapted.

In the latter case, that is to say in the case in which both reflector surface regions have a structuring, in particular facets, it is preferably provided that the structurings, in particular the facets of the two reflector surface regions are different.

It is thus even better possible to optimally design the different light distributions independently of one another in accordance with the desired and/or stipulated requirements.

For example, it can be provided that the first reflector surface region has one or more rows of facet elements running transversely, in particular in the horizontal direction.

Adjacent facet elements within a row and/or facet elements in adjacent rows for example transition here into one another discontinuously.

It can be provided that all facet elements are convex or concave, or part of the facet elements are convex and another part are concave, or at least all facet elements within a row or all facet elements are convex or at least all facet elements within a row or all facet elements are concave, or the facet elements at least within a row, preferably all rows, are convex and concave alternation.

Alternatively or preferably additionally, it can be provided that the second reflector surface region has one or more rows of facet elements running transversely, in particular in the horizontal direction.

Here, it can be advantageous if adjacent facet elements within a row and/or facet elements in adjacent rows transition into one another continuously.

It can be provided that all facet elements are convex or concave, or part of the facet elements are convex and another part are concave, or at least all facets within a row or all facet elements are convex or at least all facet elements within a row or all facet elements are concave, or the facet elements at least within a row, preferably all rows, are convex and concave in alternation.

The emission cone of the emitted light is dependent here on the curvature of the respective facets, with a smaller curvature for (in the far field) a smaller emission cone. Smaller emission cones lead to a concentration of the luminous flux, for example in the horizontal direction.

Convexly curved facets can improve the homogeneity of the light distribution, whereas concavely curved facets can be better moulded by injection moulding.

Furthermore, it can also be provided advantageously that the at least one collimator, which is associated with the at least one first light source, directs the luminous flux of the first light source substantially in parallel, wherein the luminous flux preferably runs normal to an exit plane of the collimator.

Alternatively or preferably additionally to the above-described embodiment, it can also be provided that the at least one collimator, which is associated with the at least one second light source, directs the luminous flux of the second light source substantially in parallel in a first, vertical direction, and fans out said luminous flux in a second, horizontal direction.

It can be provided that the separation into the first reflector surface region and the second reflector surface region runs horizontally.

The invention also relates to a lighting device for a motor vehicle headlight, which lighting device comprises one or more of the above-described lighting units.

A lighting unit of the above-described kind is capable of providing multiple combinations of different light distributions. However, it may also be the case that the illuminance levels achievable with just one lighting unit are too low to satisfy the legally required minimum values. With a lighting device comprising two or more corresponding lighting units, the required values of the illuminance level can be provided if the number of lighting units is selected in such a way that these can deliver the necessary luminous flux.

A lighting device comprising two or more lighting units according to the invention is also expedient when a segmented light distribution is to be generated.

In this case, each LED light source of a lighting unit generates a light segment of a light distribution, wherein either each LED light source of a lighting unit contributes to another segmented (overall) light distribution (the lighting device is in this case designed to generate two different segmented overall light distributions which can be switched on and off independently of one another), or both/all LED light sources of a lighting unit contribute to a single (overall) light distribution, i.e. the lighting device is designed to generate merely a single segmented overall light distribution.

Lastly, the invention also relates to a motor vehicle headlight comprising at least one lighting unit of the above-described kind or comprising at least one lighting device of the above-described kind.

Figure 2:
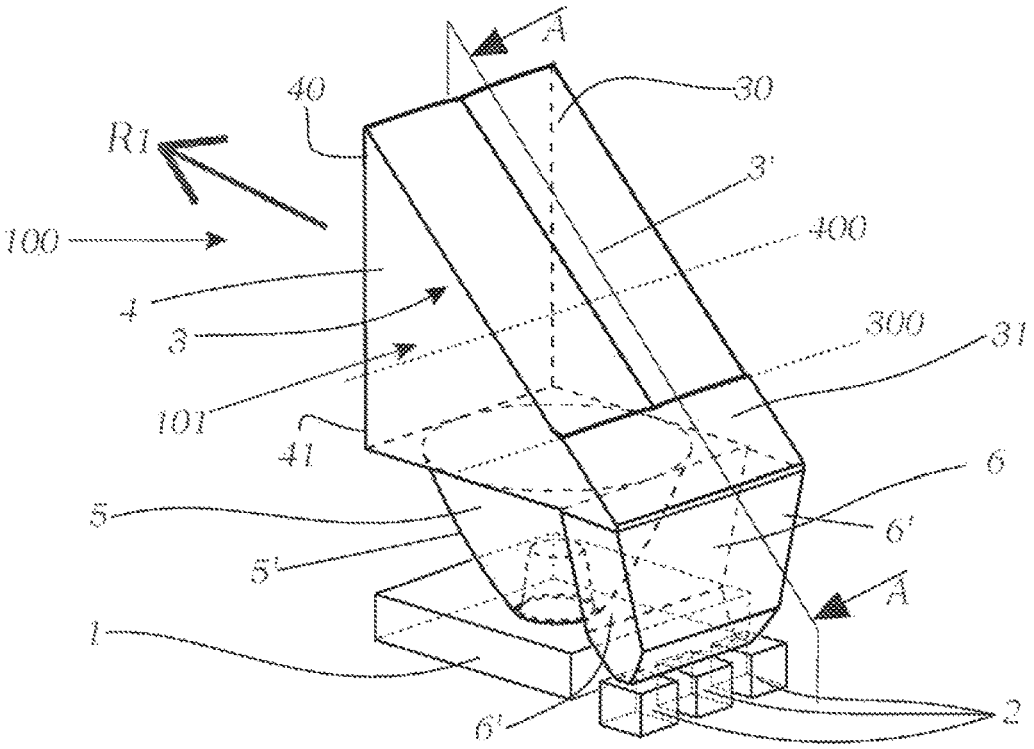
Figure 3:
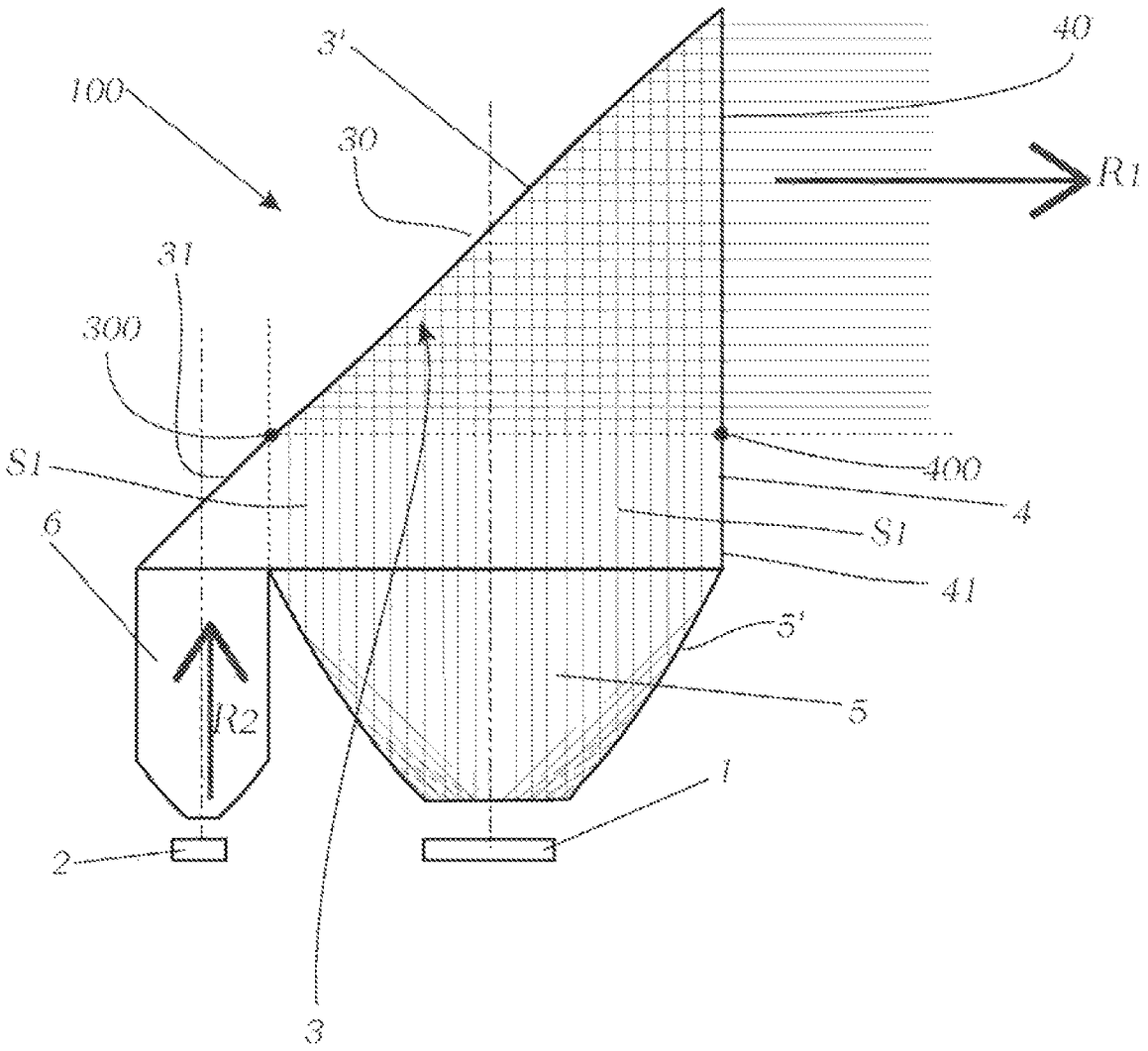
Figure 4:
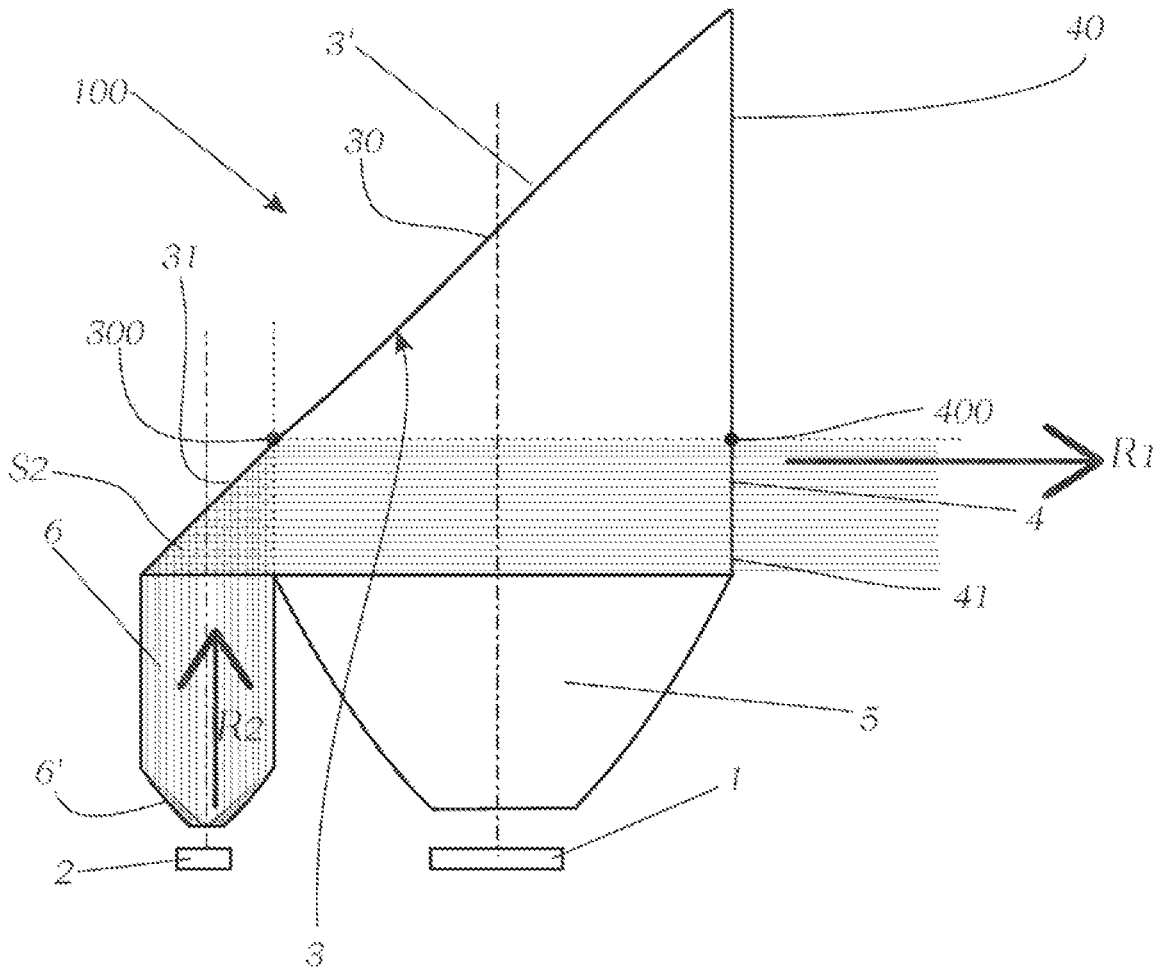
Figure 5A:
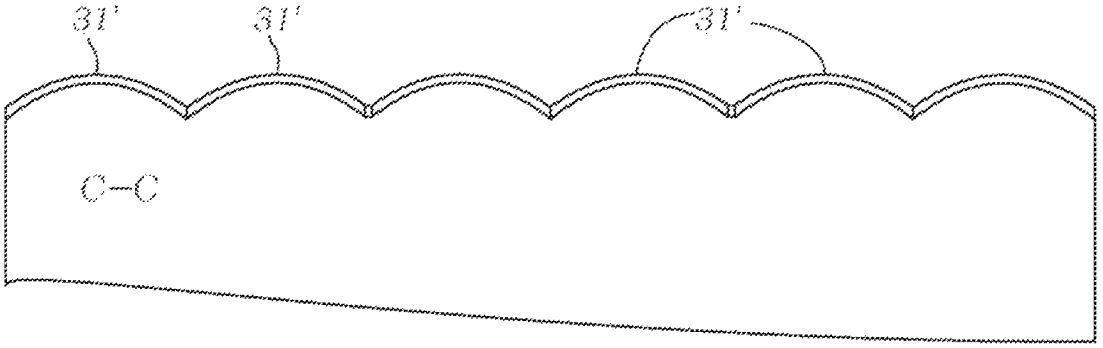
Figure 5B:
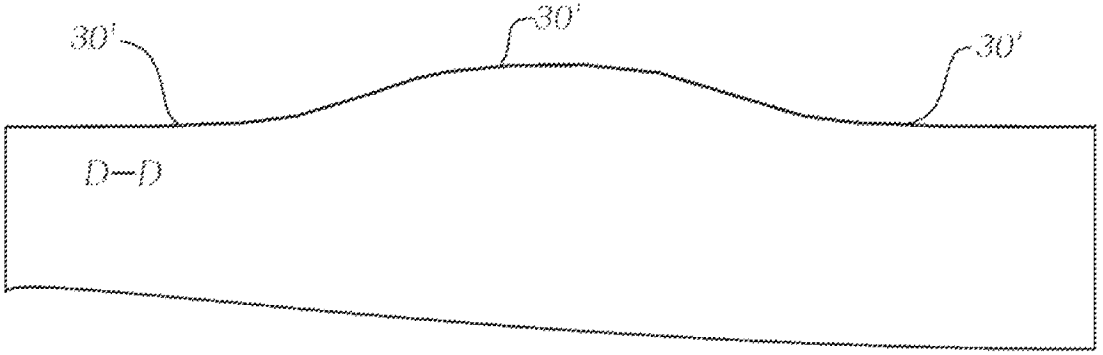
Figure 5:
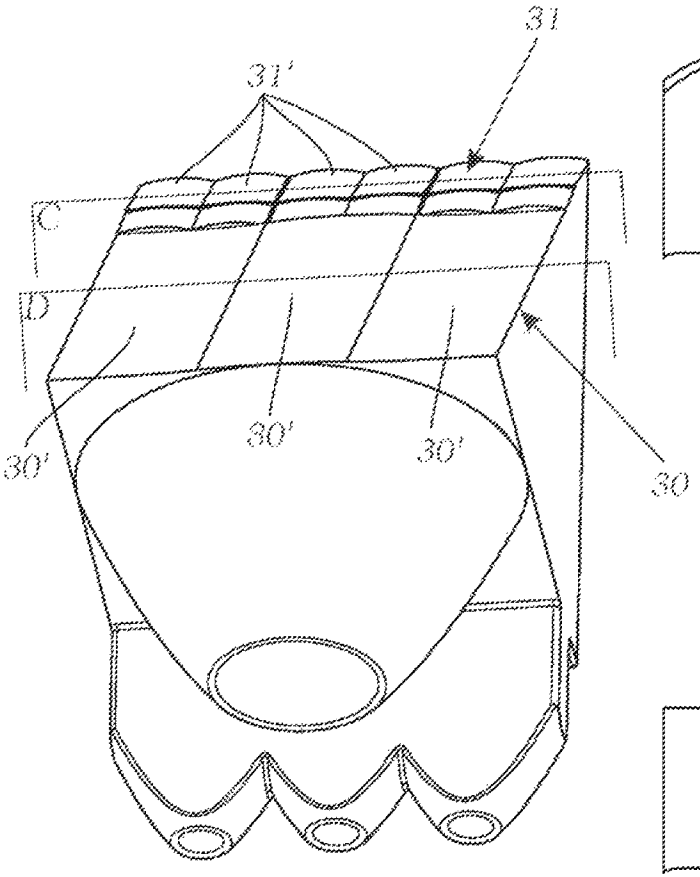
Figure 6A:
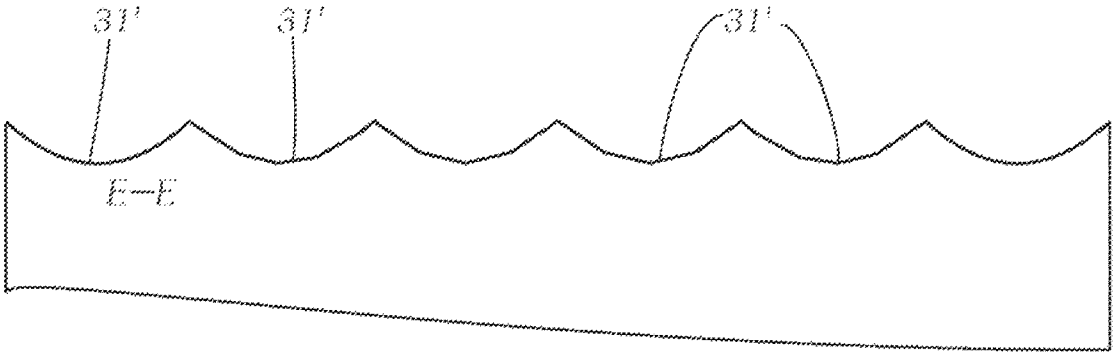
Figure 6B:
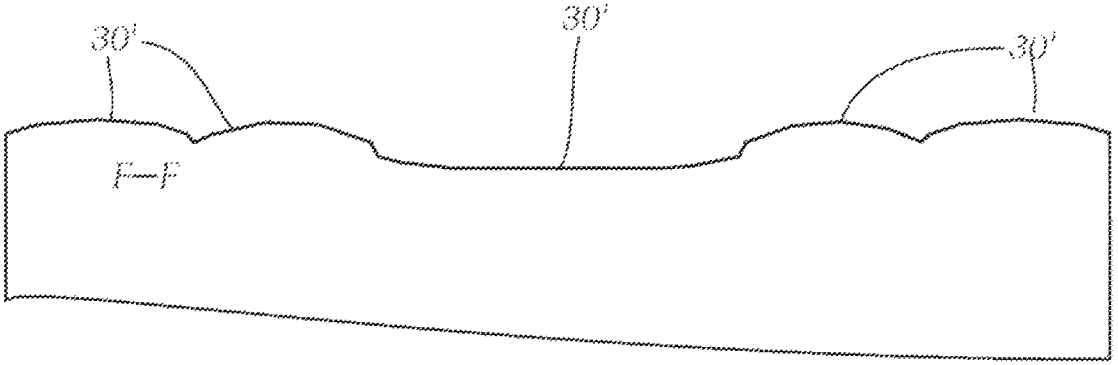
Figure 6:
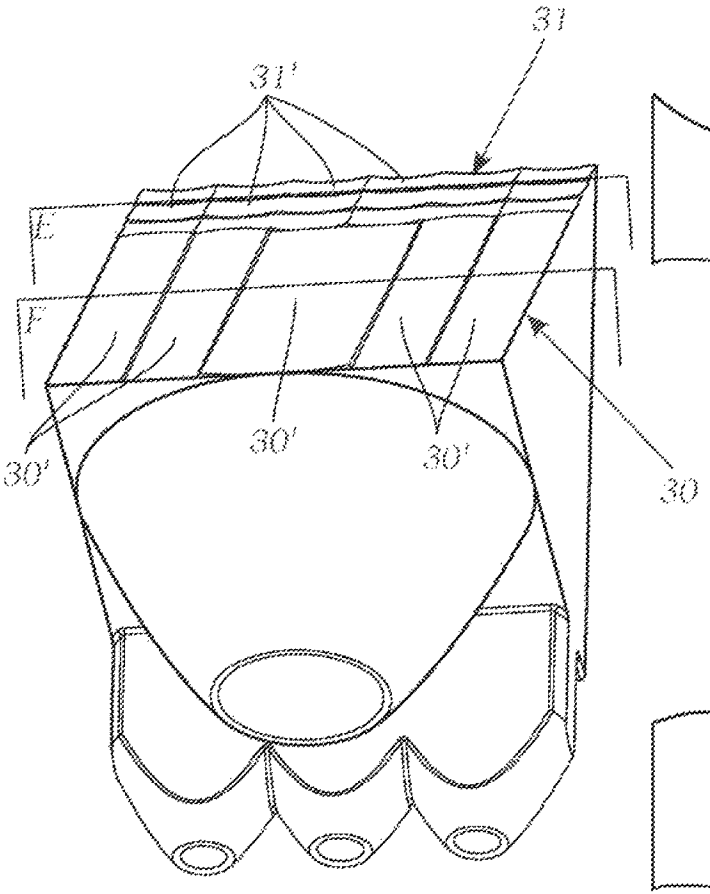
Figure 7:
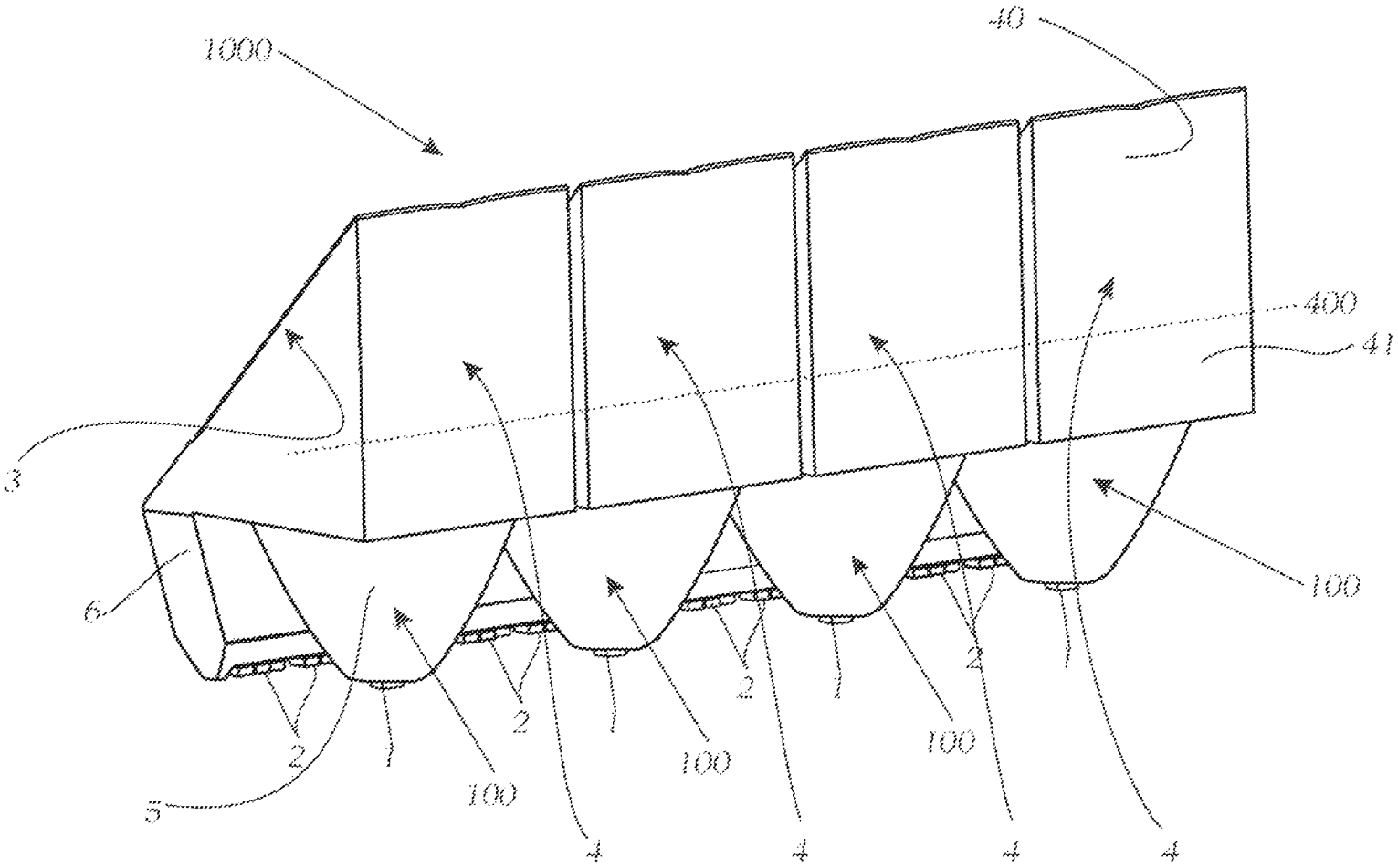

The invention will be explained in greater detail hereinafter with reference to the drawing, in which:

FIG. 1 shows a lighting device according to the invention in a perspective view, FIG. 2 shows a further lighting unit according to the invention in a perspective view, FIG. 3 shows the lighting unit from FIG. 2 in a vertical section A-A in order to show the course of the light beam of the light emitted by a first light source, FIG. 4 shows the lighting unit from FIG. 2 in a vertical section A-A in order to show the course of the light beam of the light emitted by second light source, FIG. 5 shows a lighting unit in a perspective view from below, FIG. 5*a* shows a section through the lighting unit from FIG. 5 in a plane of section C-C through the reflector surface region for generating a daytime-running-light light distribution, FIG. 5*b* shows a section through the lighting unit from FIG. 5 in a plane of section D-D through the reflector surface region for generating a main beam light distribution, FIG. 6 shows another embodiment of the lighting unit in a perspective view from below, FIG. 6*a* shows a section through the lighting unit from FIG. 6 in a plane of section E-E through the reflector surface region for generating a daytime-running-light light distribution, FIG. 6*b* shows a section through the lighting unit from FIG. 6 in a plane of section F-F through the reflector surface region for generating a main beam light distribution, and FIG. 7 shows an exemplary lighting device with four lighting units according to the invention.

Within the scope of this description, the terms "above", "below", "horizontal", "vertical" are to be understood as specifications relating to the orientation when the unit is arranged in a normal position for use once it has been installed in a lighting device mounted in the vehicle.

FIG. 1 shows a lighting unit 100 according to the invention for a motor vehicle headlight for generating two light distributions, in particular two different light distributions. It will be assumed hereinafter that the shown lighting unit 100 is designed to generate a first overall light distribution in the form of a main beam distribution and a second overall light distribution in the form of a daytime running light distribution. Other combinations can also be provided with a lighting unit 100 of the kind shown, as will be explained in greater detail further below.

In the shown example, the lighting unit 100 comprises a first light source 1 for generating the first light distribution, i.e. the main beam distribution, and three second light sources 2 for generating the second light distribution, i.e. the daytime running light distribution.

Furthermore, the lighting unit 100 comprises a reflector 3, an exit lens 4, for example in the form of a projection lens, and collimators 5, 6*a*, 6*b*, 6*c*, into which the light sources 1, 2 feed light when they are activated.

In principle, it can be provided within the scope of the invention that, in the case in which two or more light sources are responsible for a certain light distribution, these light sources couple their light into a single, common collimator.

However, it can also be provided that, as shown in the present example, each light source 2 is associated with precisely one collimator 6*a*, 6*b*, 6*c*. In principle, i.e. within the general scope of the invention, it can be provided that each light source, even when these contribute the same light distribution, is associated with precisely one collimator, into which the corresponding light source couples its light.

In the embodiment according to FIG. 1, light of the first light source 1, when said light source is switched on, is coupled into the associated collimator 5 and is oriented thereby to form a first light beam.

Light of the second light sources 2, when the light sources 2 are switched on, is coupled by the second light sources 2 into the collimators 6*a*, 6*b*, 6*c* associated therewith, and in each case is oriented to form a second light beam. In the shown example, three second light beams are thus generated, preferably superimposed, by means of which the second light distribution is generated jointly.

The reflector 3 deflects the light rays of the light beam exiting from the collimators 5, 6*a*, 6*b*, 6*c* in the direction of the exit lens 4, and the exit lens 4 images the light rays reflected by the reflector 3 in the form of the first and the second light distribution.

In particular, as will also be explained later, the exit lens 4 can be flat and the rays reflected by the reflector 3 preferably impinge on the flat exit lens 4 in an orientation normal thereto, such that said rays can pass through said lens readily, without further deflection.

Preferably—this also being applicable for the most general context of the present invention—light merely passes through the exit lens 4 and in so doing is refracted. The actual light shaping is implemented by the reflector. However, for example the width of the resultant light distribution can be adapted/adjusted by the exit lens, i.e. by an appropriate design of the exit lens 4.

The reflector 3, exit lens 4 and collimators 5, 6*a*, 6*b*, 6*c* are formed from a translucent, preferably one-piece body 101—also referred to as an "optics body"—wherein the light rays propagating in the translucent body 101 are totally reflected at the reflector delimitation surface 3' of the reflector 3 and the collimator delimitation surfaces 5', 6*a*', 6*b*', 6*c*' of the collimators 5, 6*a*, 6*b*, 6*c*.

It is provided that the reflector 3 has a first reflector surface region 30 which receives light exclusively from the first light source 1, and a second reflector surface region 31 which receives light exclusively from the second light source 2.

The exit lens 4 has a first exit lens region 40 which receives light exclusively from the first reflector surface region 30, and a second exit lens region 41 which receives light exclusively from the second reflector surface region 31.

The two reflector surface regions 30, 31 and the two exit lens regions 40, 41 are separated by a horizontally running separation (separation line) 300, 400, that is to say are arranged vertically one above the other, optionally offset.

Light emitted via the first exit lens region 40 is imaged as a first light distribution, in this example thus as a main beam distribution, and light emitted via the second exit lens region 41 is imaged as a second light distribution, in this example thus as a daytime running light distribution.

One advantage of the invention in the general, generic context, i.e. not limited to the present embodiment, is that two or more light distributions can be generated using a single optics body in which coupled-in light spreads out via total reflection, wherein, by means of the embodiment according to the invention, the different light distributions do not influence one another and also can be configured independently of one another.

The light sources 1, 2 preferably each comprise a light-emitting diode or a plurality of light-emitting diodes, and the light sources 1, 2 for each light distribution can be controlled independently of one another, i.e. in particular can be switched on and off independently of one another. It can also be provided that the light sources 1, 2—again, not limited to the shown embodiment, but also in the most general sense of the invention—can be dimmed, in particular also can be dimmed independently of one another.

Lastly, it can also be provided generally (not limited to the shown example) that in the case in which—as shown for example in FIG. 1—a plurality of light sources 2 contribute to a light distribution, these light sources 2 can be controlled independently of one another, i.e. switched on and off, and for example can also be dimmed independently of one another.

Generally, i.e. not limited to the present embodiment, the translucent material from which the body 100 is formed, for example a plastic, preferably has a refractive index greater than that of air. The material for example contains PMMA (poly(methyl methacrylate)) or PC (polycarbonate) and is in particular preferably formed therefrom.

FIG. 2 shows an arrangement similar to that from FIG. 1, and the details provided in conjunction with FIG. 1 also apply. Differences can be found in the following aspects:

The position of the light source 1 for generating a main beam distribution and that of the light sources 2 for daytime running light distribution are swapped Accordingly, the reflector surface regions 30, 31 are swapped, and so too are the position of the first exit lens region 40 and the second exit lens region 41

The three second light sources 2 couple light into a single collimator 6

The structuring of the reflector surface regions 30, 31 in the variant according to FIG. 2 is for example configured differently compared to that in FIG. 1.

In the shown examples according to FIGS. 1 and 2, the exit lens 4 is formed of a flat surface.

In the shown examples it is provided that the exit lens 4 runs at an angle of 90° to at least one light exit plane of a collimator 5, 6*a*, 6*b*, 6*c* or 5, 6.

It is also provided in the shown embodiment that the reflector 3, from its basic form, is formed as a flat surface. As will also be explained in further detail, structurings can be provided on this flat surface.

As is shown in FIGS. 1 and 2, it can be provided that the reflector 3 runs at an angle of 45° to at least one light exit plane of a collimator 5, 6*a*, 6*b*, 6*c* or 5, 6.

The light exit planes of all collimators can run parallel to one another, as is the case in the shown embodiment, and accordingly in this case the reflector is arranged at 45° to all light exit planes of collimators, and the exit lens is arranged at 90° to all light exit planes of the collimators.

In particular, it is then provided that the exit lens 4 runs at an angle of 45° to the reflector 3. FIGS. 3 and 4 also show the course of the beam in the optics body 101 on the basis of a section A-A from FIG. 2:

Light of the first light source 1, when this is switched on, is coupled into the associated collimator 5 and is oriented thereby to form a first light beam S1.

Here, light rays impinging on the delimitation surfaces 5' of the collimator 5 are totally reflected. In a central region, light rays can also enter the collimator directly, without prior reflection. The light beam S1 generated by the collimator 5 is preferably a light beam of parallel light rays (FIG. 3).

Light of the second light sources 2, when these are switched on, is coupled into the associated collimator 6 and oriented thereby to form a second light beam S2.

Here, light rays impinging on the delimitation surfaces 6*a*', 6*b*', 6*c*' or 6' of a collimator 6*a*, 6*b*, 6*c* or 6 are totally reflected. In a central region, light rays can also enter the collimator directly, without prior reflection. The light beam S2 generated by the collimator 6 is preferably a light beam of parallel light rays (FIG. 4).

The reflector 3 deflects, in the direction of the exit lens 4, the light rays of the light beams S1, S2 exiting from the collimators 5, 6, and the exit lens 4 images the light rays reflected by the reflector 3 in the form of the first and the second light distribution. Here, the first exit lens region 40 receives light exclusively from the first reflector surface region 30 (FIG. 3), and the second exit lens region 41 receives light exclusively from the second reflector surface region 31 (FIG. 4).

In particular, as is shown, the exit lens 4 can be formed flat and the rays reflected by the reflector 3 preferably impinge on the flat exit lens 4 in an orientation normal thereto, such that they can pass through said lens without further deflection. This function can also be provided in the present text by an exit lens, and the term "image" can also be understood in this text to mean that light passes through the exit lens without further deflection.

This condition applies only if the reflector generates a single parallel beam of rays. Generally, however, the reflector also outputs diverging rays, which then do not impinge on the (in particular flat) interface/exit lens at 90°, and therefore the described condition that the light rays are not deflected does not apply. The exit lens then deflects the rays accordingly and "projects" a light distribution into the traffic area.

With regard to the collimators, regardless of the specific embodiment, but also in conjunction with the embodiments shown in FIGS. 1 and 2, it can be provided that the at least one collimator 5, which is associated with the at least one first light source 1, directs the luminous flux of the first light source 1 substantially in parallel, wherein the luminous flux preferably runs normal to an exit plane of the collimator 5.

Alternatively or preferably additionally to the above-described embodiment, it can also be provided that the at least one collimator 6; 6*a*, 6*b*, 6*c*, which is associated with the at least one second light source 2, directs the luminous flux of the second light source 2 substantially in parallel in a first, vertical direction, and fans out said luminous flux in a second, horizontal direction.

The terms "vertical" and "horizontal" are to be understood here such that the light rays are influenced in such a way that they are oriented horizontally or vertically accordingly in the event of irradiation into a region in front of the lighting unit when the lighting unit is in a position corresponding to the position of installation in a motor vehicle.

As already mentioned further above, it can be advantageous if the reflector 3, i.e. in particular the first reflector surface region 30, has a structuring, for example in that the first reflector surface region 30 is divided into facets, by means of which structuring the light rays reflected by the reflector surface region 30 can be deflected in a vertical and/or horizontal direction in order to generate the first light distribution.

In this way, the light distribution generated by means of the first reflector surface region can be optimally adapted.

The terms "vertical" and "horizontal" relate here to the light pattern in a screen projection, wherein accordingly "horizontal" means "in the direction of the H-axis" and "vertical" means "in the direction of the V-axis".

Alternatively or preferably additionally, it can be provided that the second reflector surface region 31 has a structuring, for example in that a second reflector surface region 31 is divided into facets, by means of which structuring the light rays reflected by the reflector surface region 31 are deflected in a vertical and/or horizontal direction in order to generate the second light distribution.

In this way, the light distribution generated by means of second reflector surface region are optimally adapted.

FIG. 5 shows a first example of a structuring of this kind, in which both reflector surface regions have a structuring, in particular facets, wherein the structurings, in particular the facets, of the two reflector surface regions 30, 31 are different. The amplitudes are shown here in an exaggerated manner in FIGS. 5*a* and 5*b*.

It is thus even better possible to optimally design the different light distributions independently of one another in accordance with the desired and/or stipulated requirements.

FIG. 5 and FIG. 5*b*, which shows the section D-D from FIG. 5, show a first reflector surface region 30 with a row of facet elements 30' (main beam).

FIG. 5 and FIG. 5*a*, which shows the section C-C—from FIG. 5, show a second reflector surface region 31 with two horizontal rows of facet elements 31' (daytime running light).

FIG. 6 with the sections E-E (FIG. 6*a*, daytime miming light) and F-F (FIG. 6*b*, main beam) shows a further basic design possibility.

To summarise, it can be said within the most general scope of the invention that the design of the light pattern is produced preferably by way of the reflector, and the exit lens is used preferably merely as a light exit surface which allows the light to exit from the optics body 101 either without deflection or with deflection depending on the angle of incidence.

In the case of daytime running light facets with a plurality of light coupling-in regions, the emission cones can be made to overlap with concave facets, such that the homogeneity of the generated light distribution increases. This is true both in the case of the light distribution created in the far field and in the case of the lighting impression provided to a person looking at the lighting unit or the motor vehicle headlight.

Lastly, it is also possible to provide the planar lens exit surface with horizontally and/or vertically oriented prisms or corrugations in order to deflect the light in a targeted manner, for example in order to satisfy the requirements placed on the spatial illumination in the case of signal light functions.

With a lighting unit according to the invention, for example as described in the embodiments, but also in the general inventive context, two light distributions independent of one another can be generated using one optics body.

By way of example, as described in the drawings, a combination of main beam and daytime running light can be generated. Here, if the light sources are sufficiently strong, one lighting unit can generate these light distributions alone. Otherwise, two or more identical or largely identical lighting units are combined to form one lighting device, which delivers the necessary luminous flux for legally compliant light distributions.

In essence, any combinations of light distributions can be generated, for example a combination of main beam and turn signal (indicator), in particular in the form of a sweeping indicator. Here too, a plurality of lighting units are preferably combined to form a lighting device, for example the first light sources generate the main beam distribution and the second light sources generate the indicator light, wherein the second light sources can also be switched on in succession in order to generate a sweeping indicator by means of which the direction of the turning manoeuvre can be displayed.

With a lighting device of this kind, but also in the general context of a lighting device comprising two or more lighting units, it can be provided that the same light distribution is generated via each exit lens region, and in sum the necessary illuminance is provided by means of the two or more lighting units. It can also be provided, however, that each exit lens region of a light distribution generates only a segment of this light distribution, such that a segmented light distribution, for example a segmented main beam distribution, can be generated.

Further possible combinations of light distributions as can be generated with a lighting unit or lighting device according to the invention are detailed in the following table:

| | Light distribution A | Light distribution B |
|---|---|---|
| a) | Main beam | Daytime running light (dimmed opt. position light) |
| b) | Main beam | Turn signal |
| c) | Daytime running light (dimmed opt. position light) | Turn signal |

-continued

| | Light distribution A | Light distribution B |
|---|---|---|
| d) | Daytime running light (dimmed opt. position light) | Marker light |
| e) | Partial main beam segments | Partial main beam segments |
| f) | Laser main beam spot | Main beam width (LED) |
| g) | Laser main beam spot | Signal light function |

As already described above, a lighting unit according to the invention is in principle able to provide multiple combinations of different light distributions. However, it may also be the case that the achievable illuminances with just one lighting unit are too low to reach the legally prescribed minimum values. With a lighting device comprising two or more corresponding lighting units, the required values of the illuminance can be provided if the number of lighting units is selected in such a way that these can deliver the necessary luminous flux.

A lighting device comprising two or more lighting units according to the invention is also expedient when a segmented light distribution is to be generated. In this case, each LED light source of a lighting unit generates a light segment of a light distribution, wherein either each LED light source of a lighting unit contributes to a different segmented (overall) light distribution (the lighting device is in this case designed to generate two different segmented overall light distributions which in particular can be switched on and off independently of one another), or both LED light sources of a lighting unit contribute to a single (overall) light distribution, i.e. the lighting device is designed to generate merely a single segmented overall light distribution.

FIG. 7 shows an example of a lighting device 1000 of this kind. In the shown example, said lighting device consists of four lighting units 100, which again each have first light sources 1 and second light sources 2, as described above. With an arrangement of this kind, the above-described superimposition possibilities can be provided, for example.

As shown, there are preferably no further optical elements arranged downstream of a lighting unit or lighting device according to the invention. However, it can be provided that an additional imaging lens is arranged downstream of a lighting unit, or each lighting unit, or a lighting device.

The invention claimed is:

1. A lighting unit for a motor vehicle headlight for generating at least two light distributions, wherein the lighting unit comprises:

at least one first light source (1) for generating a first light distribution, at least one second light source (2) for generating a second light distribution, a reflector (3), an exit lens (4), in particular in the form of a projection lens, and collimators (5, 6; 5, 6*a*, 6*b*, 6*c*) into which the light sources (1, 2) can feed light, wherein light of the at least one first light source (1) is oriented by the at least one collimator (5) associated with the at least one first light source (1) to form a first light beam (S1), and light of the at least one second light source (2) is oriented by the at least one collimator (6; 6*a*, 6*b*, 6*c*) associated with the at least one second light source (2) to form a second light beam (S1), wherein the reflector (3) deflects, in the direction of the exit lens (4), the light rays of the light beams (S1, S2)

exiting the collimators (5, 6; 5, 6*a*, 6*b*, 6*c*), and wherein the exit lens (4) images the light rays reflected by the reflector (3) in the form of the first and the second light distribution, wherein the reflector (3), exit lens (4) and collimators (5, 6; 5, 6*a*, 6*b*, 6*c*) are formed from a translucent body (100), and wherein the light rays (S1, S2) propagating in the translucent body (101) are totally reflected at a reflector delimiting surface of the reflector (3') and preferably at the collimator delimiting surfaces (5', 6'; 5', 6*a*', 6*b*', 6*c*') of the collimators (5, 6; 5, 6*a*, 6*b*, 6*c*), wherein the reflector (3) has a first reflector surface region (30) which receives light exclusively from the at least one first light source (1), wherein the reflector (3) has a second reflector surface region (31) which receives light exclusively from the at least one second light source (2), wherein the exit lens (4) has a first exit lens region (40) which receives light exclusively from the first reflector surface region (30), wherein the exit lens (4) has a second exit lens region (41) which receives light exclusively from the second reflector surface region (31), and wherein light irradiated via the first exit lens region (40) is imaged as a first light distribution and light irradiated via the second exit lens region (4) is imaged as a second light distribution.

2. The lighting unit according to claim 1, wherein the light sources each comprise one or more LEDs, wherein the light sources (1, 2) are single-chip LEDs.

3. The lighting unit according to claim 1, wherein the exit lens (4) is formed as a flat or planar surface.

4. The lighting unit according to claim 3, wherein the exit lens (4) runs at an angle of 90° to a light exit plane of at least one collimator (5, 6; 5, 6*a*, 6*b*, 6*c*).

5. The lighting unit according to claim 1, wherein the reflector (3) is formed as a flat surface.

6. The lighting unit according to claim 5, wherein the reflector (3) runs at an angle of 45° to a light exit plane of at least one collimator (5, 6; 5, 6*a*, 6*b*, 6*c*).

7. The lighting unit according to claim 3, wherein the exit lens (4) runs at an angle of 45° to the reflector (3).

8. The lighting unit according to claim 1, wherein the first reflector surface region (30) has a structuring which is configured such that the first reflector surface region (30) is divided into facets, with which light rays reflected by the reflector surface region (30) are deflected in a vertical and/or horizontal direction in order to generate the first light distribution.

9. The lighting unit according to claim 1, wherein the second reflector surface region (31) has a structuring which is configured such that the second reflector surface region (31) is divided into facets, with which light rays reflected by the reflector surface region (31) are deflected in a vertical and/or horizontal direction in order to generate the second light distribution.

10. The lighting unit according to claim 8, wherein facets of the first and second reflector surface regions (30, 31) are different from one another.

11. The lighting unit according to claim 10, wherein the first reflector surface region (30) has one or more rows of facet elements (30') running transversely in the horizontal direction.

12. The lighting unit according to claim 11, wherein adjacent facet elements (30') within a row and/or facet elements (30') in adjacent rows transition into one another discontinuously.

13. The lighting unit according to claim 11, wherein:

all facet elements are convex or concave, part of the facet elements are convex and another part are concave, at least all facet elements within a row or all facet elements are convex, at least all facet elements within a row or all facet elements are concave, or the facet elements at least within a row are convex and concave in alternation.

14. The lighting unit according to claim 9, wherein the second reflector surface region (31) has one or more rows of facet elements (31') running transversely in the horizontal direction.

15. The lighting unit according to claim 14, wherein adjacent facet elements (31') within a row and/or facet elements (31') in adjacent rows transition into one another continuously.

16. The lighting unit according to claim 14, wherein:

all facet elements are convex or concave, part of the facet elements are convex and another part are concave, at least all facet elements within a row or all facet elements are convex, at least all facet elements within a row or all facet elements are concave, or the facet elements at least within a row are convex and concave in alternation.

17. The lighting unit according to claim 1, wherein the at least one collimator (5), which is associated with the at least one first light source (1), directs the luminous flux of the first light source (1) substantially in parallel, wherein the luminous flux runs normal to an exit plane of the collimator (5).

18. The lighting unit according to claim 1, wherein the at least one collimator (6; 6*a*, 6*b*, 6*c*), which is associated with the at least one second light source (2), directs the luminous flux of the second light source (2) substantially in parallel in a first, vertical direction, and fans out said luminous flux in a second, horizontal direction.

19. The lighting unit according to claim 1, wherein the separation (300) into the first reflector surface region (30) and the second reflector surface region (31) runs horizontally.

20. A lighting device for a motor vehicle headlight, which lighting device comprises one or more lighting units according to claim 1.

21. A motor vehicle headlight comprising at least one lighting unit according to claim 1.

* * * * *